United States Patent [19]

Updegraff

[11] Patent Number: 4,463,060

[45] Date of Patent: Jul. 31, 1984

[54] SOLDERABLE PALLADIUM-NICKEL COATINGS AND METHOD OF MAKING SAID COATINGS

[75] Inventor: Stephen W. Updegraff, Mechanicsburg, Pa.

[73] Assignee: E. I. Du Pont de Nemours and Company, Wilmington, Del.

[21] Appl. No.: 551,925

[22] Filed: Nov. 15, 1983

[51] Int. Cl.[3] ..... C23C 3/00; C25D 3/56; C25D 5/48; B23K 1/20

[52] U.S. Cl. ..... 428/669; 204/43 N; 204/35.1; 228/211; 428/670; 428/671; 428/675; 428/680

[58] Field of Search ..... 204/35 R, 43 N; 228/206, 211; 428/607, 669, 670, 671, 675, 680

[56] References Cited

U.S. PATENT DOCUMENTS 4,416,741 11/1983 Schulze-Berge ..... 204/43 N

FOREIGN PATENT DOCUMENTS 2747955 5/1978 Fed. Rep. of Germany ... 204/43 N
45-8769 3/1970 Japan ..... 204/43 N

*Primary Examiner*—G. L. Kaplan

[57] ABSTRACT

A permanently solderable palladium-nickel electroplated coating is formed on electrically conductive surfaces. The coating has a first alloy layer of 46 to 82 atomic percent palladium and 18 to 54 atomic percent nickel. This first layer is covered by a continuous second layer of 96 to 100 atomic percent metallic palladium and 0–4 atomic percent nickel. The second layer has a thickness of up to twenty angstroms. The second layer is formed by dipping the first layer in a solution of sulfuric or hydrochloric acid.

7 Claims, 3 Drawing Figures

SOLDERABLE PALLADIUM-NICKEL COATINGS AND METHOD OF MAKING SAID COATINGS

BACKGROUND OF THE INVENTION

1. Field of the Invention

This invention relates to electrically conductive coated surfaces. More specifically, it refers to a permanently solderable palladium-nickel alloy coating on an electrically conductive substrate.

2. Description of the Prior Art

Gold platings are commonly used to protect electrical contacts from corrosion and at the same time maintain solderability properties and low electrical contact resistance at low loads. Unfortunately, gold platings are extremely expensive. Lower cost substitutes have been sought such as palladium-nickel alloys. A typical method of forming a palladium-nickel alloy on an electrically conductive substrate is set forth in U.S. Pat. No. 4,100,039. While known palladium nickel alloys provide a less expensive corrosion-resistant layer, they suffer from reduced solderability properties and increased electrical contact resistance at low normal loads.

SUMMARY OF THE INVENTION

I have discovered a palladium-nickel electroplated surface coating for an electrically conductive substrate that effectively protects the substrate from corrosion and at the same time is permanently solderable and exhibits reduced electrical contact resistance at low loads. My coating is an electrodeposited alloy layer about 0.1 to 1.5 micrometers thick of about 46 to 82 atmoic percent palladium and about 18 to 54 atomic percent nickel adhered to an electrically conductive substrate such as nickel, brass, copper or phosphor bronze. Over this layer is a continuous covering surface layer of about 96 to 100 atomic percent metallic palladium and about 0–4 atomic percent nickel. This surface layer has a thickness no greater than about twenty angstroms Å or approximately 9 to 10 atomic layers.

DESCRIPTION OF THE DRAWINGS

The present invention may be best understood by those having ordinary skill in the art by reference to the following detailed description when considered in conjunction with the accompanying drawings in which.

DESCRIPTION OF THE PREFERRED EMBODIMENT

The coating surface of this invention is prepared by first starting with a substrate such as a phosphor bronze wire which is electroplated in a bath containing 10 to 18 grams per liter palladium (II) ammine chloride, 5 to 11 grams per liter nickel ammine sulfate, a small amount of brightener such as sodium vinyl sulfonate, sodium allyl sulfonate or quaternized pyridine and 30 to 50 grams per liter ammonium sulfate or ammonium chloride.

The electroplating conditions require a temperature of about 35° C. to 55° C., a pH of about 7.5–9, a current density of about 5 to 25 amp/sq dm, and a vigorous agitation while the wire is in solution. A coating of palladium-nickel of about 0.1 to 1.5 micrometers thick is produced. The coating has a bulk content of 46–82 atomic percent palladium and the balance nickel.

I found that by treating the palladium-nickel surface with either sulfuric or hydrochloric acid, there is created an extremely thin, continuous layer of 96–100 atomic percent metallic palladium and 4-0atomic percent nickel on top of the electroplated coating of palladium-nickel alloy. The thickness of the palladium enriched surface layer is less than or equal to 20 Å, which is equivalent to about 9–10 atomic layers.

The continuous film, of 96–100% pure palladium achieved by treating with sulfuric or hydrochloric acid, which is only 20 Å thick, cannot be desposited on any polycrystalline surface via electroplating or by vapor phase deposition techniques. It is well established that attempts to electroplate or vapor phase deposit coatings having a 20 Å thick layer produce deposits of isolated islands of atoms and not a continuous layer such as produced by my acid treatment. The first continuous film that can be formed by electroplating or vapor phase processes has a thickness in the order of 150–1000 Å, contrasted to the 20 Å thickness produced in my coating.

Figure 1:
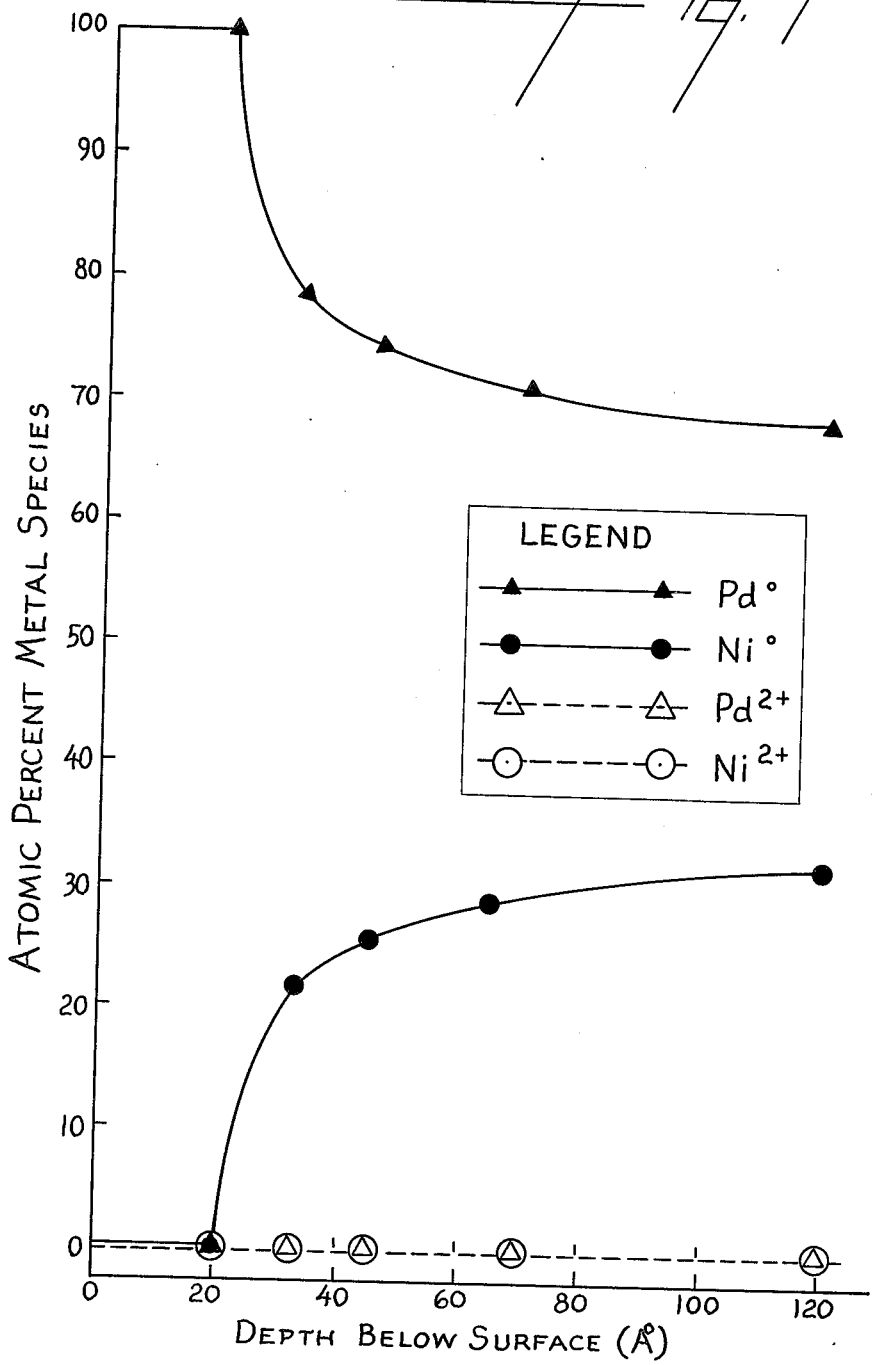
FIG. 1 is a graph of Sample 1c in Example 1 having as the abscissa, the coating depth below the surface in angstroms and as the ordinate, the atomic percent metal species.
Figure 2:
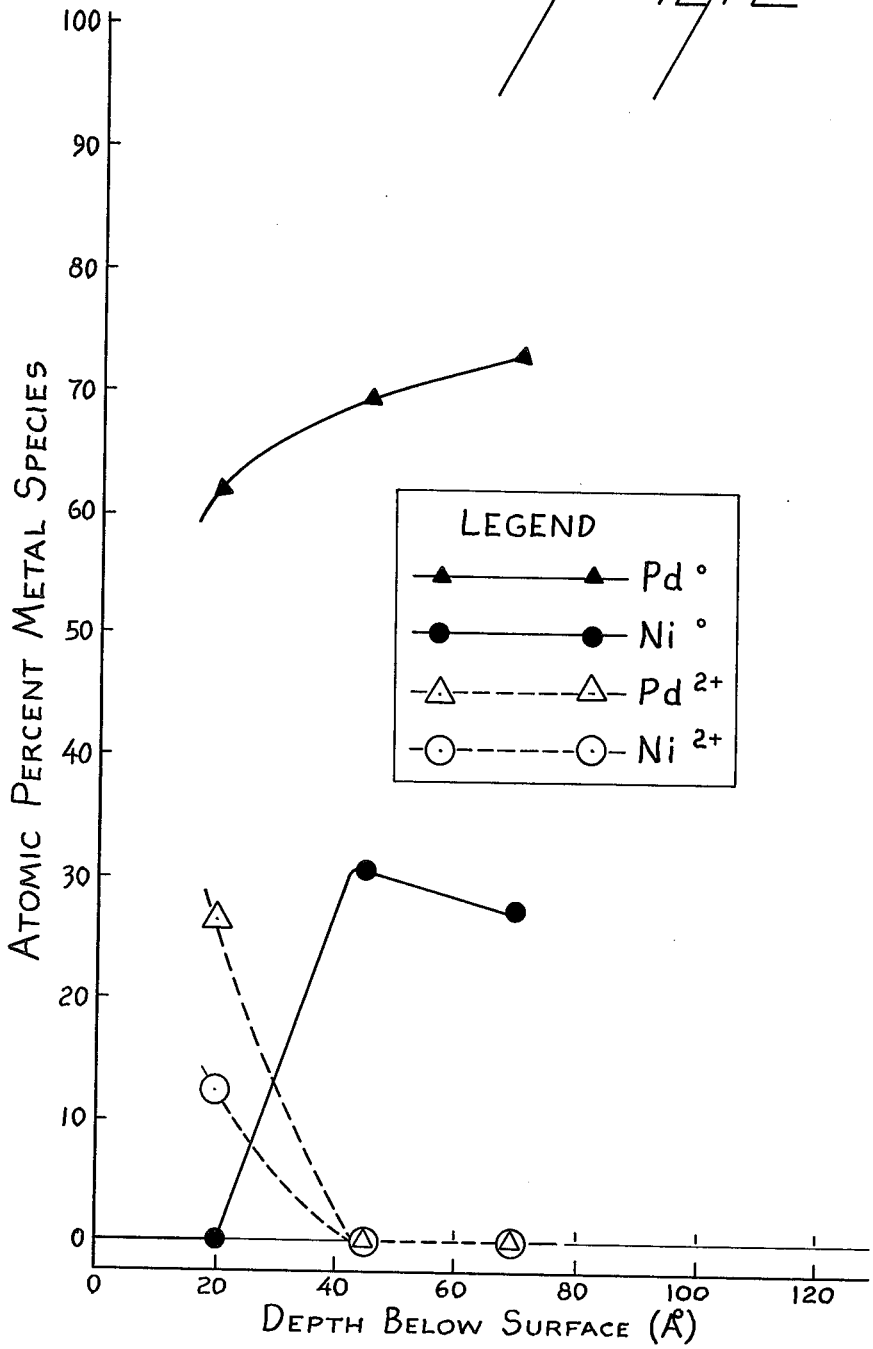
FIG. 2 is a graph of Sample 2a in Example 2 having as the abscissa, the coating depth below the surface in angstroms and as the ordinate, the atomic percent metal species.
Figure 3:
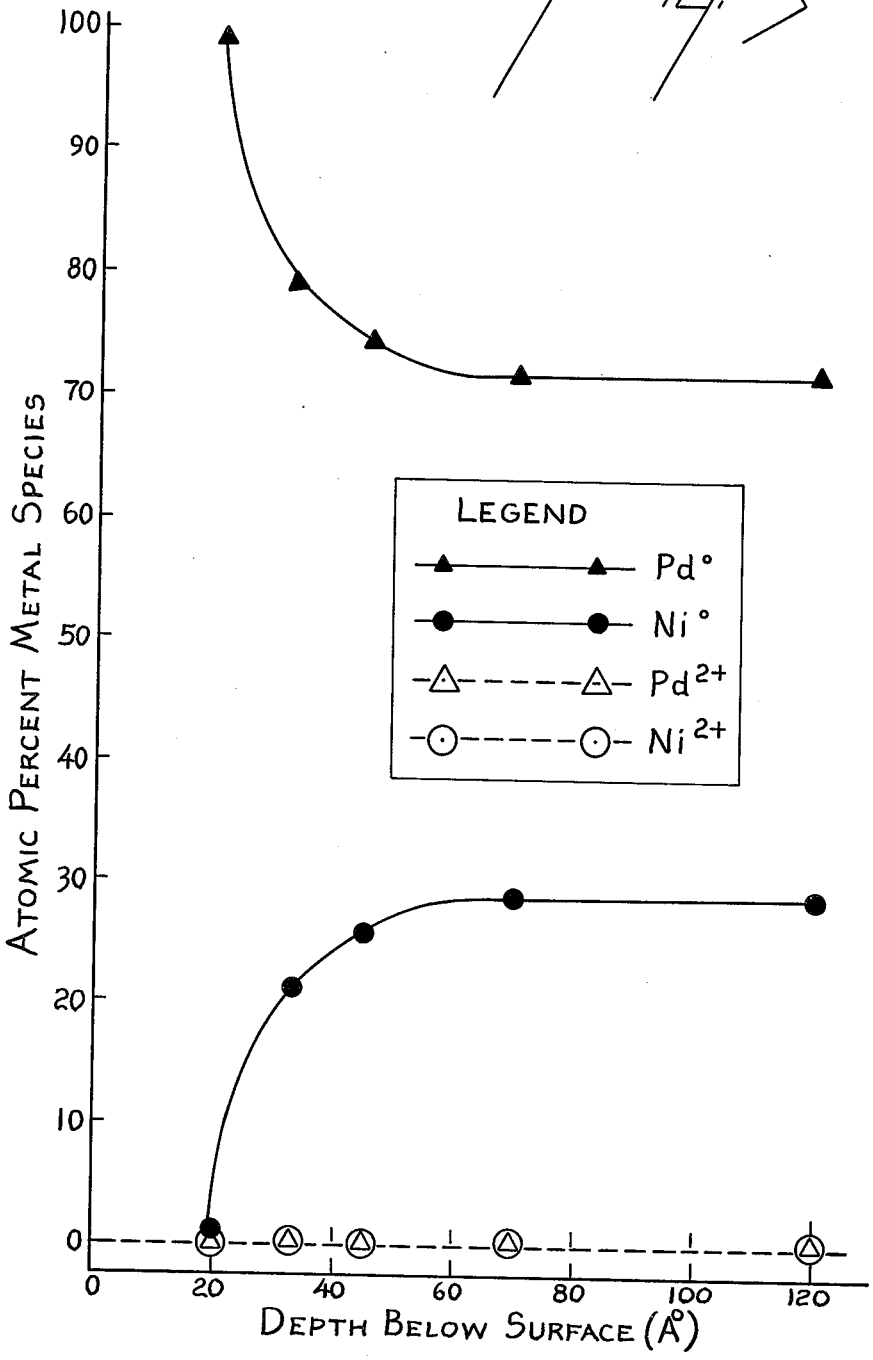
FIG. 3 is a graph of Sample 2b of Example 2 having as the abscissa, the coating depth below the surface in angstroms and as the ordinate, the atomic percent metal species.

FIGS. 1 and 3 show the elemental composition profiles for acid-treated palladium-nickel alloy surfaces that are the fingerprint of this invention. These profiles are distinctly different from those of as plated bulk palladium-nickel surfaces that have been office-aged in an industrial environment such as that shown in FIG. 2. The office-aged surfaces contain substantial amounts of ionic nickel species, $Ni^{2+}$ and, in some cases, ionic $Pd^{2+}$ series which are present as oxides and chlorides. These aged surfaces do not pass the solderability tests and they exhibit high electrical contact resistance at low contact loads. After acid treatment according to the teachings of this invention, the surface consists of 96–100 atomic percent metallic palladium ($Pd^{o}$) and a small amount, 4-0 atomic percent metallic nickel. The acid-treated surfaces exhibit excellent solderability and possess low electrical contact resistance (less than 22 mΩ at 10 grams normal force).

The extremely thin continuous palladium-rich layer of this invention is stable against destruction by oxidation to ionic species. It is also stable against destruction by diffusion of nickel to surface from bulk of the alloy. This stability is evidenced by no change in the composition of properties during a variety of aging treatments to which electronic components are subjected including the following:

- Exposure to industrial office and storage environments for times up to and exceeding 28 months;
- Accelerated steam aging as described by Military Standards 202, method 208 for certification of electronic components; and
- Aging at elevated temperatures in air as prescribed by certain electronic component users.

Significant changes during aging are observed in the chemistry and performance of untreated palladium-nickel alloy coatings affecting their solderability and electrical performance.

The acid treating procedures used to produce the unique coatings of this invention are achieved by immersing electrolytically deposited palladium-nickel coatings in a static aqueous solution composed of 20 volume percent concentrated sulfuric acid for 30 seconds at ambient temperature. After treatment, the coating is rinsed thoroughly and allowed to dry.

Concentration ranges of 1 through 100 volume percent concentrated sulfuric acid may be used to achieve this invention. As concentrations of the sulfuric acid approach 1 volume percent in a static solution, treatment time must be lengthened to produce the unique coating surface, i.e., immersing electrolytically deposited palladium-nickel in a static aqueous solution of of 1 volume percent concentrated sulfuric acid for 30 minutes at ambient temperature.

Agitation has a significant effect on acquired dwell time in the treatment solution. With vigorous agitation, the invention can be achieved by immersing an electrolytically deposited palladium-nickel coating in a solution of 10 volume percent concentrated sulfuric acid for 0.4 sec. at ambient temperature.

Immersion of electrolytically deposited palladium-nickel in a static solution of 20 volume percent concentrated hydrochloric acid for 30 seconds at ambient temperature will also yield the described surface.

Not all acid solutions are useful in achieving this invention. Treatment with aqueous solutions such as 20 volume percent concentrated nitric acid, 50 volume percent glacial acetic acid, and 50 volume percent concentrated phosphoric acid yield surfaces which are not similar to those described in the invention.

X-ray Photoelectron Spectroscopy (XPS) technique, also referred to as Electron Spectroscopy for Chemical Analysis (ESCA), was used for chemical analysis of the surfaces of palladium-nickel alloy coatings. XPS analysis is based upon a determination of the binding energy for orbital electrons that are removed from the atoms at the surface when it is bombarded with soft x-rays. Binding energies of the emitted orbital photoelectrons indicate not only the elements that are present but also the valence state of the elements. Therefore, in XPS analysis of palladium-nickel alloy surfaces, it is possible to determine the atomic percent of the elements in the metallic or zero valence state ($Pd^o$ and $Ni^o$ species) and the atomic percent of the elements in positive ionic valence states ($Pd^{2+}$ and $Ni^{2+}$) that are present in compounds such as oxides and chlorides.

The XPS conditions for my investigation were as follows:

Type of X-Ray Radiation: MgK (1253.6 eV)
Accelerating voltage: 15 kV
Tube power setting: 300 Watts
Beam width at ½ maximum intensity: 4.5 μm
Take-off angle: 50°

In the calculation of the XPS surface chemistry for the samples of this invention, only the metal element components were considered. The binding energies of the photoelectrons used to determine the atomic percent of metal components for the palladium-nickel alloy surfaces are listed below:

| ELEMENTAL COMPONENT | ELECTRON ORBIT DESIGNATION | BINDING ENERGY eV |
|---|---|---|
| $Pd^o$ | $3d_{5/2}$ | 335 |
| $Pd^{2+}$ | $3d_{5/2}$ | 339 |

-continued

| ELEMENTAL COMPONENT | ELECTRON ORBIT DESIGNATION | BINDING ENERGY eV |
|---|---|---|
| $Ni^o$ | $2p_{3/2}$ | 852 |
| $Ni^{2+}$ | $2p_{3/2}$ | 855 |

In the XPS analysis of palladium-nickel alloy coatings, the region being analyzed for nickel extends to a depth of over about 20 angstroms (Å) below the surface because the nickel $2p_{3/2}$ electrons excited from depths greater than this do not have sufficient energy to escape from the coating. A depth below the surface of the palladium-nickel alloy of 20 Å is equivalent to about 9 to 10 atomic layers. The thickness of the electrodeposited palladium-nickel alloy coatings under investigation ranged from 0.1 to 1.5 micrometers (μm) which is equivalent to 1000–15,000 Å. The XPS technique is ideally suited for the chemical analysis of thin regions at the surface of the palladium-nickel alloy coatings that determine their solderability and their electrical contact resistance, two of the most important properties of the coatings for electronic connector applications.

For selective samples, XPS chemistry profiles were obtained for the metal element components as a function of distance (X) below the original surface. The first step was to conduct an XPS analysis of the original surface layer which extends from X=0 to 20 Å. Then, defined thicknesses of material were removed by argon ion sputtering and XPS analyses were conducted after each thickness removal step. The incremental thicknesses that were removed by sputtering in terms of distance (X) from the original surface were 12.5, 25, 50 and 100 Å. In all cases, the region being analyzed extended to the depth of 20 Å below the surface under analysis. Therefore, the compositional data input in XPS profiles such as those in FIGS. 1, 2 and 3 were plotted at locations 20 Å below the surface being analyzed or at distances of 32.5, 45, 70 and 120 Å below the original surface. FIG. 1 shows a typical XPS profile.

The conditions for argon sputter removal of material from palladium-nickel alloy surfaces were as follows:

Ion source: Argon gas
Ion acceleration voltage: 4 kV

Careful control of these conditions and the sputtering current resulted in a reproducible unform sputter removal rate of 22 Å/min on palladium-nickel alloy coatings.

The bulk palladium-nickel coating before acid treatment had significant amounts of $Pd^{2+}$ and $Ni^{2+}$ on its surface which prevents easy wetting by soldering. This is evidenced by only an 80% solder coverage. In order to achieve industry standard solderability approval, the solder coverage must be at least 95%. The use of state of the art solder fluxes such as Alpha 611 and 809 at room temperatures did not significantly reduce or remove $Pd^{2+}$ or $Ni^{2+}$ to the metallic species and therefore the solderability was not improved.

EXAMPLES

The following specific examples describe the invention in greater detail. All examples were carried out on copper alloy substrates, either a wire or disk, that had been subjected to conventional preplate treatments as practiced in the art and then electroplated with a pure nickel coating by a conventional nickel sulfamate plating process. The nickel undercoat prevents copper contamination of the plating bath but is not necessary to the practice of the invention.

All sufuric acid treatments except as otherwise noted consisted of immersion in a twenty volume percent sulfuric acid solution for thirty seconds at ambient temperature.

EXAMPLE 1

A palladium-nickel alloy coating 0.9 μm thick was electrodeposited on nickel-plated copper alloy wire substrates using the following bath chemistry and plating conditions:

| | |
|---|---|
| Bath Chemistry | |
| Pd Concentration: | 17 g/l as palladium (II) ammine chloride |
| Ni Concentration: | 10 g/l as nickel ammine sulfate |
| Sodium vinyl sulfonate: | 14 g/l |
| Ammonium sulfate: | 50 g/l |
| Plating Conditions | |
| Temperature | 37° C. |
| pH: | 8.9 |
| Current Density: | 25 amp/sq dm |
| Solution Agitation: | Vigorous |

The bulk electroplated palladium-nickel alloy on the wire contained 81 atomic percent palladium and 19 atomic percent nickel. The plated samples were then subjected to the treatments outlined in Table I.

TABLE I

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 1a | Office aged for 12 months in an industrial environment | 80 | 9 | 0 | 11 | 91 |
| 1b | Office aged for 12 months plus Sulfuric acid treatment | 100 | 0 | 0 | 0 | 99 |
| 1c | Office aged for 12 months Sulfuric acid treatment Office aged for 18 months in an industrial environment | 100 | 0 | 0 | 0 | 98 |

After each treatment the surface chemistry was determined by XPS analysis and solderability was evaluated according to United States Military Standard 202, Method 208.

The original surface (X=0 to 20 Å) of an electrodeposited palladium-nickel alloy coating aged for 12 months in an industrial office environment consisted of a mixture of $Ni^{2+}$, $Pd^{2+}$ and $Pd^o$ species. See XPS analysis for Sample 1a in Table I. The aged surface with these species failed the solderability dip test since solder coverage was less than 95% of the coating surface. Sulfuric acid treatment of the aged palladium-nickel alloy coating created a surface consisting of a continuous layer of pure metallic palladium ($Pd^o$) and 99% coverage in the solderability test. See Sample 1b. The absence of nickel $Ni^{2+}$ or $Ni^o$ species after sulfuric acid treatment indicates that the 100% pure metallic palladium layer is continuous.

The chemistry of the pure metallic palladium ($Pd^o$) surface layer created by the sulfuric acid treatment was unchanged after 18 months of aging in an industrial office environment. There is no indication of diffusion of nickel from the bulk palladium-nickel alloy coating to the surface or of oxidation of the metallic palladium ($Pd^o$) species to a $Pd^{2+}$ species. See Sample 1c. The thickness of the stable, continuous, pure, metallic palladium layer on Sample 1c is only 20 Å as indicated by the XPS chemistry profiles in FIG. 1.

EXAMPLE 2

Another set of palladium-nickel electroplated wires prepared in the same manner as the samples of Example 1 were subjected to the treatments outlined in Table II:

TABLE II

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 2a | Office aged for 22 months in an industrial environment | 62 | 26 | 0 | 12 | 80 |
| 2b | Office aged for 22 months plus Sulfuric acid treatment | 99 | 0 | 1 | 0 | 100 |

After the treatments, XPS chemistry profiles were obtained of the surfaces to a depth of 120 Å and the solderability was evaluated on a set of replicate samples.

XPS composition depth profiles for these samples appear in FIGS. 2 and 3. The office-aged (Sample 2a) sample which failed the solderability test has a surface with substantial amounts of $Ni^{2+}$ and $Pd^{2+}$ species and only 62 atomic percent metallic palladium ($Pd^o$) as shown in FIG. 2. Sample 2b that was sulfuric acid treated after office aging passed the solderability test. It has a 20 Å thick surface layer that is 99 atomic percent metallic palladium ($Pd^o$) and one atomic percent metallic nickel ($Ni^o$) as shown in FIG. 3.

EXAMPLE 3

A palladium-nickel coating 1.3 μm thick having a bulk composition of 76 atomic % palladium and 24 atomic % nickel was electrodeposited on a nickel-plated copper alloy disk using the bath chemistry and plating conditions set forth below:

| | |
|---|---|
| Bath Chemistry | |
| Pd Concentration: | 18 g/l as palladium (II) ammine chloride |
| Ni Concentration: | 10 g/l as nickel ammine sulfate |
| Sodium Allyl Sulfonate: | 1.7 g/l |
| Ammonium Sulfate: | 50 g/l |
| Plating Conditions | |
| Temperature: | 55° C. |
| pH: | 8.7 |
| Current Density: | 16 amp/sq dm |

-continued

| | |
|---|---|
| Solution Agitation: | Vigorous |

The plated samples were then subjected to the treatments outlined in Table III.

TABLE III

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 3a | Office aged for 25 months in an industrial environment | 90 | 0 | 0 | 10 | 92 |
| 3b | Office aged for 25 months plus Sulfuric acid treatment | 100 | 0 | 0 | 0 | 98 |

After the treatments, XPS chemistry profiles were obtained of the sample surfaces to a depth of 120 Å and the solderability was evaluated on a set of replicate samples.

Sample 3a failed the solderability test whereas the sulfuric acid-treated Sample 3b passed the solderability test.

EXAMPLE 4

A palladium-nickel coating 0.8 μm thick having a bulk composition of 70 atomic percent palladium and 30 atomic percent nickel was electrodeposited on a nickel-plated copper alloy disk using the bath chemistry and plating conditions set forth below:

| | |
|---|---|
| Bath Chemistry | |
| Pd Concentration: | 11.8 g/l as palladium (II) ammine chloride |
| Ni Concentration: | 5.2 g/l as nickel chloride |
| Quaternized Pyridine: | 600 ppm |
| Ammonium Chloride: | 30 g/l |
| Plating Conditions | |
| Temperature: | 50° C. |
| pH: | 8.5 |
| Current Density: | 5 amp/sq dm |
| Solution Agitation: | Vigorous |

The plated samples were then subjected to the treatments outlined in Table IV.

TABLE IV

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 4a | Office aged for 28 months in an industrial environment | 83 | 0 | 0 | 17 | 93 |
| 4b | Office aged for 28 months plus Sulfuric acid treatment | 100 | 0 | 0 | 0 | 99 |

After treatment, XPS chemistry profiles were obtained of the sample surfaces to a depth of 120 Å and the solderability was evaluated on a set of replicate samples.

Sample 4a failed the solderability test whereas the acid-treated Sample 4b passed.

EXAMPLE 5

A palladium-nickel coating 0.8 μm thick having a bulk composition of 55 atomic percent palladium and 45 atomic percent nickel was electrodeposited on a nickel-plated copper alloy disk using the bath chemistry and plating conditions set forth below:

| | |
|---|---|
| Bath Chemistry | |
| Pd Concentration: | 10 g/l as palladium (II) ammine chloride |
| Ni Concentration: | 6 g/l as nickel chloride |
| Quaternized Pyridine: | 600 ppm |
| Ammonium Chloride: | 30 g/l |
| Plating Conditions | |
| Temperature: | 50° C. |
| pH: | 7.5 |
| Current Density: | 5 amp/sq dm |
| Solution Agitation: | Vigorous |

The plated samples were then subjected to the treatments outlined in Table V.

TABLE V

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 5a | Aged at 125° C. for 50 hrs. in air and Office aged for 28 months in an industrial environment | 69 | 0 | 0 | 31 | 89 |
| 5b | Aging treatment of 5a plus Sulfuric acid treatment | 100 | 0 | 0 | 0 | 99 |

After the treatment, XPS chemistry profiles were obtained of the sample surfaces to a depth of 120 Å and the solderability was evaluated on a set of replicate samples.

Sample 5a failed the solderability test whereas the acid-treated Sample 5b passed.

EXAMPLE 6

A palladium-nickel coating 1.3 μm thick having a bulk composition of 46 atomic percent palladium and 54 atomic percent nickel was electrodeposited on a nickel-plated copper alloy disk using the bath chemistry and plating conditions set forth below:

| | |
|---|---|
| Bath Chemistry | |
| Pd Concentration: | 17 g/l as palladium (II) ammine chloride |
| Ni Concentration: | 11 g/l as nickel ammine sulfate |
| Sodium Vinyl Sulfonate | 2.8 g/l |
| Ammonium Sulfate: | 50 g/l |
| Plating Conditions | |
| Temperature: | 48° C. |
| pH: | 8.0 |
| Current Density: | 8.7 amp/sq dm |
| Solution Agitation: | Vigorous |

The plated samples were then subjected to the treatments outlined in Table VI.

TABLE VI

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 6a | Aged in steam for 1 hr. as per Military Standard 202, Method 208 | 56 | 0 | 0 | 44 | 80 |
| 6b | Steam aged as per Military Standard plus Sulfuric acid treatment | 98 | 0 | 0 | 2 | 100 |

After the treatments, XPS chemistry profiles were obtained of the sample surfaces to a depth of 120 Å and the solderability was evaluated on a set of replicate samples.

Sample 6a failed the solderability test whereas the acid-treated Sample 6b passed.

EXAMPLE 7

A palladium-nickel alloy coating 0.9 μm thick having a bulk composition of 81 atomic percent palladium and 19 atomic percent nickel was electrodeposited on nickel-plated copper alloy wire using the bath chemistry and plating conditions set forth below:

| | |
|---|---|
| Bath Chemistry | |
| Pd Concentration: | 17 g/l as palladium (II) ammine chloride |
| Ni Concentration: | 10 g/l as nickel ammine sulfate |
| Sodium Vinyl Sulfonate: | 1.4 g/l |
| Ammonium Sulfate: | 50 g/l |
| Plating Conditions | |
| Temperature: | 37° C. |
| pH: | 8.9 |
| Current Density: | 25 amp/sq dm |
| Solution Agitation: | Vigorous |

The plated samples were then subjected to the treatments outlined in Table VII.

TABLE VII

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 7a | Office aged for 24 months in an industrial environment plus Sulfuric acid treatment | 96 | 0 | 4 | 0 | 100 |
| 7b | Office aged for 24 months in an industrial environment plus Sulfuric acid treatment plus | 96 | 0 | 4 | 0 | 99 |

TABLE VII-continued

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| | Steam aging for 1 hr. as per Military Standard 202, Method 208 | | | | | |

After the treatments, XPS chemistry profiles were obtained of the sample surfaces to a depth of 120 Å and the solderability was evaluated on a set of replicate samples.

Both sulfuric acid-treated samples passed the 95% minimum solder coverage criterion. Steam aging of one sample after sulfuric acid treatment according to the Military Standard did not change its palladium-rich composition or its ability to pass the solderability criterion.

EXAMPLE 8

A palladium-nickel alloy coating 0.9 μm thick was electrodeposited on nickel-plated copper alloy wire using the following bath chemistry and plating conditions:

| | |
|---|---|
| Bath Chemistry | |
| Pd Concentration: | 17 g/l as palladium (II) ammine chloride |
| Ni Concentration: | 10 g/l as nickel ammine sulfate |
| Sodium Vinyl Sulfonate: | 1.4 g/l |
| Ammonium Sulfate: | 50 g/l |
| Plating Conditions | |
| Temperature: | 37° C. |
| pH | 8.9 |
| Current Density | 25 amp/sq dm |
| Solution Agitation: | Vigorous |

The plated samples were then subjected to the treatments outlined in Table VIII.

TABLE VIII

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 8a | Aged for 24 mos. in an industrial environment | 27 | 40 | 0 | 33 | 80 |
| 8b | Aged for 24 mos. in an industrial environment plus Sulfuric acid treatment | 100 | 0 | 0 | 0 | 100 |
| 8c | Aged for 24 mos. in an industrial environment and treated with 100 volume % $H_2SO_4$ for 30 sec at ambient temperatures | 100 | 0 | 0 | 0 | 095 |
| 8d | Aged for 24 mos. in an | 100 | 0 | 0 | 0 | 096 |

TABLE VIII-continued

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| | industrial environment and treated with 1 volume % $H_2O_4$ for 30 sec at ambient temperatures | | | | | |

After the treatments, XPS chemistry profiles were obtained of sample surfaces to a depth of 120 Å and the solderability was evaluated on a set of replicate samples.

Sample 8a failed the solderability test whereas all the sulfuric acid-treated samples passed.

Samples 8c and 8d demonstrate the effect of acid concentration on surface characteristics. Sample 8c was treated in 100 volume percent sulfuric acid for 30 seconds and was found to pass the solderability criterion. Sample 8d was treated in 1 volume percent sulfuric acid for 30 minutes and also demonstrated acceptable solder coverage.

EXAMPLE 9

Another set of palladium-nickel electroplated wires prepared in the same manner as the samples of Example 8 were subjected to the treatments outlined in Table IX:

TABLE IX

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 9a | Aged for 24 mos. in an industrial environment | 27 | 40 | 0 | 33 | 80 |
| 9b | Aged for 24 mos. in an industrial environment and treated with 50% $H_3PO_4$ for 30 sec. at ambient temperature | 92 | 0 | 0 | 08 | 85 |

After the treatments, XPS chemistry profiles were obtained of sample surfaces to a depth of 120 Å and the solderability was evaluated on a set of replicate samples. Both samples failed the solderability test.

EXAMPLE 10

Another set of palladium-nickel electroplated wires prepared in the same manner as the samples of Example 8 were subjected to the treatments outlined in Table X:

TABLE X

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 10a | Aged for 24 mos. in an industrial environment | 27 | 40 | 0 | 33 | 80 |
| 10b | Aged for 24 mos. in an industrial environment and treated with 50% glacial acetic acid for 30 sec. at ambient temperature | 88 | 0 | 0 | 12 | 75 |

After the treatments, XPS chemistry profiles were obtained of sample surfaces to a depth of 120 Å and the solderability was evaluated on a set of replicate samples. Both samples failed the solderability test.

EXAMPLE 11

Another set of palladium-nickel electroplated wires prepared in the same manner as the samples of Example 8 were subjected to the treatments outlined in Table XI:

TABLE XI

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 11a | Aged for 24 mos. in an industrial environment | 27 | 40 | 0 | 33 | 80 |
| 11b | Aged for 24 mos. in an industrial environment and treated with 20% $HNO_3$ for 30 sec at ambient temperature | 90 | 0 | 0 | 10 | 90 |

After the treatments, XPS chemistry profiles were obtained of sample surfaces to a depth of 120 Å and the solderability was evaluated on a set of replicate samples. Both samples failed the solderability test.

EXAMPLE 12

Another set of palladium-nickel electroplated wires prepared in the same manner as the sample of Example 8 were subjected to the treatments outlined in Table XII:

TABLE XII

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 12a | Aged in an | 27 | 40 | 0 | 33 | 80 |

TABLE XII-continued

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| | industrial environment for 24 mos. | | | | | |
| 12b | Aged in an industrial environment for 24 mos., treated in RMA flux per MIL-STD-202, Method 208, and rinsed in denatured ethanol | 52 | 26 | 0 | 22 | 85 |
| 12c | Same as 12b except steam aged after ethanol rinse | 38 | 26 | 0 | 36 | 50 |

After the treatments, XPS chemistry profiles were obtained of sample surfaces to a depth of 120 Å and the solderability was evaluated on a set of replicate samples. All three samples failed the solderability test.

EXAMPLE 13

Another set of palladium-nickel electroplated wires prepared in the same manner as the samples of Example 8 were subjected to the treatments outlined in Table XIII:

TABLE XIII

| Sample Code | Treatment History | 20 Å Surface Layer Composition (Atomic %) $Pd^o$ | $Pd^{2+}$ | $Ni^o$ | $Ni^{2+}$ | Solderability (% Coverage) |
|---|---|---|---|---|---|---|
| 13a | Aged in an industrial environment for 24 mos. | 27 | 40 | 0 | 33 | 80 |
| 13b | Aged in an industrial environment for 24 mos., treated in a strongly activated flux per MIL-STD 202, Method 208, and rinsed in denatured ethanol | 6 | 54 | 0 | 40 | 75 |
| 13c | Same as 13b except steam aged after ethanol rinse | 0 | 60 | 0 | 40 | 45 |

After the treatments, XPS chemistry profiles were obtained of sample surfaces to a depth of 120 Å and the solderability was evaulated on a set of replicate samples. All samples failed the solderability test.

EXAMPLE 14

A palladium-nickel alloy coating 0.9 μm thick was electrodeposited on nickel-plated copper alloy disk using the bath chemistry and plating conditions set forth below:

| | |
|---|---|
| Bath Chemistry | |
| Pd Concentration: | 17 g/l as palladium (II) ammine chloride |
| Ni Concentration: | 11 g/l as nickel ammine sulfate |
| Sodium Vinyl Sulfonate: | 2.8 g/l |
| Ammonium Sulfate: | 50 g/l |
| Plating Conditions | |
| Temperature: | 48° C. |
| pH | 8.0 |
| Current Density: | 8.70 amp/sq dm |
| Solution Agitation: | Vigorous |

The plated samples were than subjected to the treatments outlined in Table XIV:

TABLE XIV

| Sample Code | Treatment History | 20 Å Surface Layer Composition (Atomic %) $Pd^o$ | $Pd^{2+}$ | $Ni^o$ | $Ni^{2+}$ | mΩ Contact Resistance (10 g load) |
|---|---|---|---|---|---|---|
| 14a | Office aged for 4 mos. in an industrial environment | 88 | 0 | 0 | 12 | 4.70 |
| 14b | Office aged for 4 mos. in an industrial environment plus steam aging per MIL-STD 202, Method 208 | 56 | 0 | 0 | 44 | 9.44 |
| 14c | Office aged for 4 mos. in an industrial environment plus sulfuric acid treatment | 99 | 0 | 1 | 0 | 1.69 |
| 14d | Office aged for 4 mos. in an industrial environment plus sulfuric acid treatment plus steam aging per MIL-STD 202, Method 208 | 99 | 0 | 1 | 0 | 1.96 |

After the treatments, XPS chemistry profiles were obtained of sample surfaces to a depth of 120 Å. The contact resistance was evaluated on a set of replicate samples per Military Standard 1344, Method 3002 with the following details:

| | |
|---|---|
| Normal Load: | 10 grams force |
| Test Current: | 10 mA DC |
| Open Circuit Voltage: | 20 mV DC maximum |

The sulfuric acid-treated samples 14c and 14d have a low point contact resistance similar to that of a gold electroplated contact surface.

Having thus described the invention, what is claimed and desired to be secured by Letters Patent is:

1. A permanently solderable article comprising a palladium-nickel electroplated coating on an electrically conductive substrate said coating having A first alloy layer of 46 to 82 atomic percent palladium and 18 to 54 atomic percent nickel adhered to the substrate and a second continuous layer covering said first layer of 96 to 100 atomic percent metallic palladium and 0-4 atomic percent nickel, the second layer having a thickness up to twenty angstroms.

2. The article according to claim 1 wherein the second layer has an electrical contact resistance at low loads of less than two mΩ at 10 grams normal force.

3. The article according to claim 1 wherein the substrate is wire.

4. The article according to claim 1 wherein the substrate is phosphor bronze alloy.

5. The article according to claim 1 wherein the substrate is nickel plated copper base alloy.

6. The article according to claim 1 wherein the first alloy layer is 0.1 to 1.5 micrometers thick.

7. A process for obtaining a permanently solderable palladium-nickel coating on an electrically conductive substrate comprising immersing the substrate in an electroplating bath consisting of (1) palladium II ammine chloride, (2) nickel ammine sulfate or nickel chloride, (3) a brightener selected from the group consisting of sodium vinyl sulfonate, sodium allyl sulfonate and quaternized pyridine and (4) ammonium sulfate or chloride, at a temperature between 35°-55° C., a pH of 7.5 to 9, a current density of 5 to 25 amp/sq dm, with vigorous agitation to form a plated surface, and thereafter immersing the plated surface in a static aqueous solution of sulfuric or hydrochloric acid.

* * * * *

UNITED STATES PATENT OFFICE

CERTIFICATE OF CORRECTION

PATENT NO. : 4,463,060

DATED : July 31, 1984

INVENTOR(S) : Stephen W. Updegraff

It is certified that error appears in the above-identified patent and that said Letters Patent are hereby corrected as shown below:

In the specification, column 2, line 48, delete "22" at the end of the line and replace with --2--.

Signed and Sealed this

*Twenty-sixth* Day of *March 1985*

[SEAL]

*Attest:*

DONALD J. QUIGG

*Attesting Officer*

*Acting Commissioner of Patents and Trademarks*